US008267769B2

(12) United States Patent
Yoshizawa

(10) Patent No.: US 8,267,769 B2
(45) Date of Patent: Sep. 18, 2012

(54) GAMING SYSTEM HAVING A PLURALITY OF SLOT MACHINES AND CONTROL METHOD OF THE GAMING SYSTEM

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 982 days.

(21) Appl. No.: 12/268,000

(22) Filed: Nov. 10, 2008

(65) Prior Publication Data

US 2009/0203421 A1 Aug. 13, 2009

Related U.S. Application Data

(60) Provisional application No. 61/027,256, filed on Feb. 8, 2008.

(51) Int. Cl.
*A63F 9/24* (2006.01)

(52) U.S. Cl. ..... 463/20; 463/16

(58) Field of Classification Search ..... 463/16–20, 463/25–29
See application file for complete search history.

(56) References Cited

U.S. PATENT DOCUMENTS

| | | | | |
|---|---|---|---|---|
| 2002/0025843 | A1 | 2/2002 | Bryant | |
| 2008/0026848 | A1 * | 1/2008 | Byng | 463/42 |
| 2008/0102916 | A1 * | 5/2008 | Kovacs et al. | 463/16 |
| 2009/0124345 | A1 * | 5/2009 | Gilmore et al. | 463/20 |

* cited by examiner

*Primary Examiner* — Omkar Deodhar
(74) *Attorney, Agent, or Firm* — Lexyoume IP Meister, PLLC.

(57) ABSTRACT

A gaming system of the present invention includes a plurality of slot machines. Each of the slot machines includes a display that displays a symbol and a controller that rearranges a symbol arranged on the display. The respective displays provided to the plurality of slot machines display symbols that are located on the displays respectively when a plurality of symbols are scrolled on one continuous display band obtained by virtually connecting the displays.

4 Claims, 11 Drawing Sheets

GAMING SYSTEM HAVING A PLURALITY OF SLOT MACHINES AND CONTROL METHOD OF THE GAMING SYSTEM

CROSS REFERENCE TO RELATED APPLICATION

This application claims the benefit of U.S. Provisional Application No. 61/027,256, filed on Feb. 8, 2008 which application is incorporated herein by reference in its entirety.

BACKGROUND OF THE INVENTION

1. Field of the Invention

The present invention relates to a gaming system having a plurality of slot machines and a control method of the gaming system.

2. Description of Related Art

In a conventional slot machine, for example as disclosed in a U.S. Patent Publication No. 2002/0025843, when a player inserts any number of medals into a medal insertion slot and operates a start button in a slot game, symbols are scroll-displayed and stopped in sectioned areas consisting of many columns and rows on a display. When the symbols constituting a winning combination are stopped on a preset payline or a predetermined number of scatter symbols are stopped, a payout according to the number of medals inserted is generated.

There is a gaming system that includes several slot machines, accumulates some of medals inserted in the slot machines and when symbols constituting a specific winning combination are stopped in any one of the slot machines, pays out, as a jackpot, the medals according to the number of the inserted medals accumulated, in the corresponding slot machine.

In the above gaming system, each slot machine determines whether to generate a jackpot. As a result, it is difficult to share a sense of playing a game that acquires the same jackpot, among the slot machines.

In addition, there is a gaming system including several slot machines and a specific device that is connected to the slot machines, accumulates some of medals inserted in the slot machines and determines the number of medals to be paid out for each slot machine.

In the above gaming system, the number of medals to be paid out in each slot machine is determined by the specific device. Like this, when the payout of each slot machine is determined by the specific device, a slot machine connected to the specific device is a machine exclusive to the specific device and does not function independently. In addition, since the number of slot machines to be equipped is fixed, an inefficient case may occur.

Therefore, a gaming system is needed, which enables players at the several slot machines to share a sense of playing a game, efficiently, thereby providing a new entertainment characteristic.

An object of the invention is to provide a gaming system capable of providing a new entertainment characteristic and a control method thereof.

SUMMARY OF THE INVENTION

According to a first aspect of the invention, there is provided a gaming system including a plurality of slot machines, in which each of the slot machines includes a display that displays a symbol and a controller that rearranges a symbol arranged on the display, and in which the respective displays provided to the plurality of slot machines display symbols that are located on the displays respectively when a plurality of symbols are scrolled on one continuous display band obtained by virtually connecting the displays.

According to a second aspect of the invention, there is provided a gaming system including a plurality of slot machines, in which each of the slot machines includes a main display that displays a plurality of symbols, a sub display that displays a symbol and a controller that, while rearranging symbols arranged on the main display and generating a prize to be determined by the rearranged symbols, rearranges a symbol arranged on the sub display, and in which the respective sub displays provided to the plurality of slot machines display symbols that are located on the sub displays respectively when a plurality of symbols are scrolled on one continuous display band obtained by virtually connecting the sub displays.

According to a third aspect of the invention, there is provided a control method of a gaming system having a plurality of slot machines, the method including displaying, on respective displays provided to the plurality of slot machines, symbols that are located on the displays respectively when a plurality of symbols are scrolled on one continuous display band obtained by virtually connecting the displays.

DETAILED DESCRIPTION OF THE EMBODIMENT (Outline)

Figure 1:
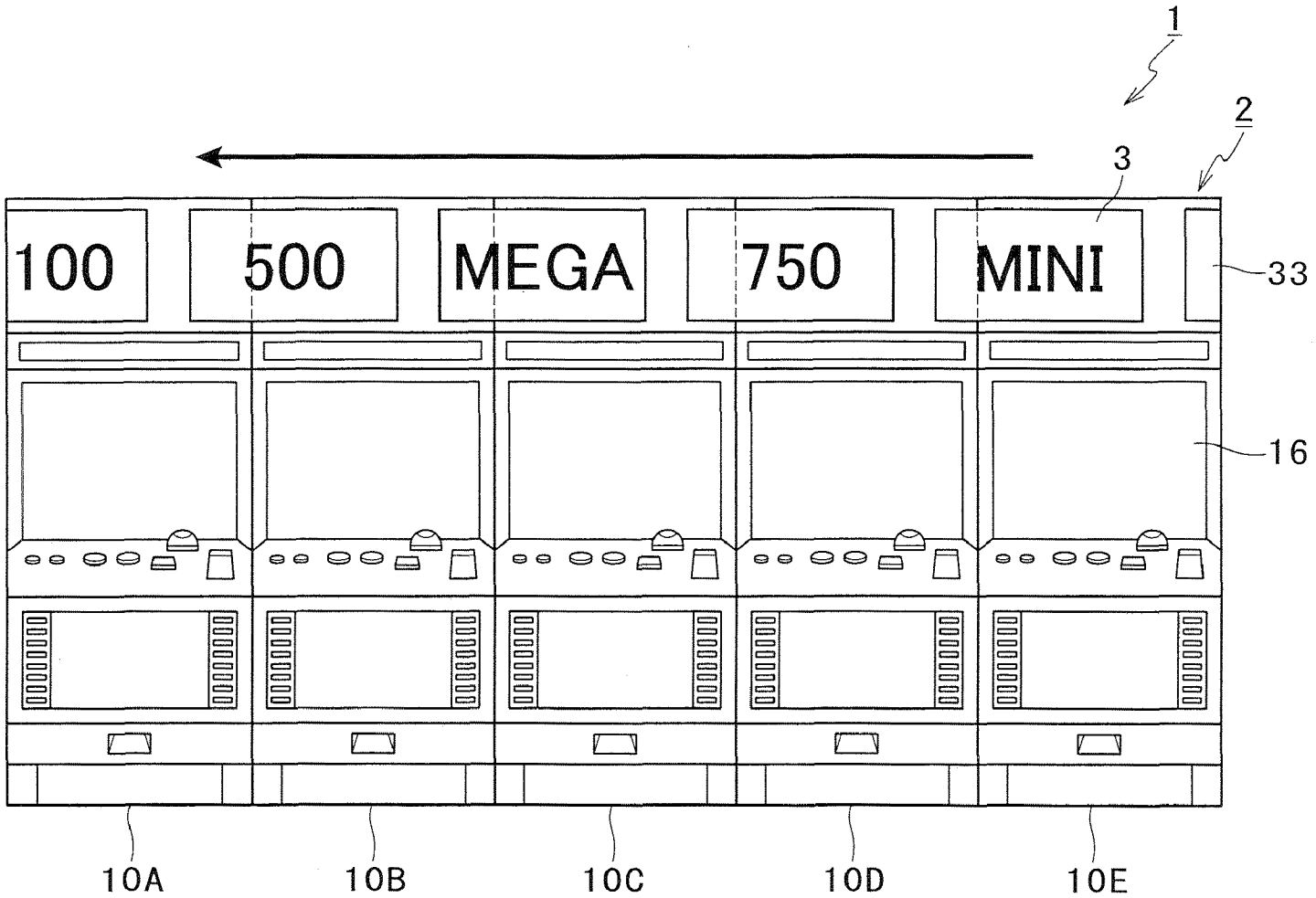
FIG. 1 shows an external appearance of a gaming system according to a first embodiment of the invention.

A gaming system of the invention includes several slot machines. The slot machine includes a display that displays a symbol and a controller that rearranges a symbol arranged on the display. The respective displays provided to the slot machines display symbols that are located on the displays respectively when several symbols are scrolled on one continuous display band obtained by virtually connecting the displays.

To be more specific, the slot machine of the gaming system includes a main display that displays many symbols, a sub display that displays a symbol and a controller that, while rearranging symbols arranged on the main display and generating a prize to be determined by the rearranged symbols, rearranges a symbol arranged on the sub display. The respective sub displays display symbols that are located on the sub displays respectively when several symbols are scrolled on one continuous display band obtained by virtually connecting the sub displays.

In other words, the gaming system is controlled by a control method of displaying, on the respective displays provided to the slot machines, symbols that are located on the displays respectively when several symbols are scrolled on one continuous display band obtained by virtually connecting the displays.

Here, the "arrangement" means a state in which the symbols are visible with eyes by a player. For example, it means a state in which the symbols are displayed on a liquid crystal display. In the mean time, the "rearrangement" means arranging the symbols again after freeing the arrangement of the symbols. In addition, in this embodiment, a "payline" is provided to determine a combination of the symbols. In other words, when the symbols are rearranged on and out of the payline, a combination is determined only for the symbols rearranged on the payline. When, as a result of the determination for a combination, a winning combination is made, a process of paying out a coin based on the winning combination, or the like is carried out.

Further, in this embodiment, a "scatter symbol" is a symbol whose condition for making a prize is the arrangement thereof only, and irrespective of the payline L. In other words, when the scatter symbol is rearranged, a prize is made and carried out is, for example, a process of paying out a coin on the basis of the number of all the scatter symbols rearranged on and out of the payline. The "symbol" means all symbols used in the slot machine and includes the scatter symbol.

Furthermore, each controller provided to the slot machine generates a prize that is determined by the symbols arranged on the display. To be more specific, each controller generates a prize that is determined by the symbols arranged on the sub display. In other words, the gaming system is controlled by a control method in which each controller generates a prize that is determined by the symbols arranged on the display.

Furthermore, each controller rearranges the symbols arranged on the main display. When the rearranged symbols satisfy a predetermined second game start condition, each controller rearranges the symbol on the sub display while rearranging the symbols on the main display.

(Mechanical Structure)

FIG. 1 shows an external appearance of a gaming system according to a first embodiment of the invention.

The gaming system 1 has several (five slot machines in this embodiment) slot machines 10 (10A to 10E). Each of the slot machines 10 is connected to each other by a cable (not shown).

The slot machine 10 has an upper display 33 at an upper part thereof and a liquid crystal display 16 at a lower part thereof. The liquid crystal display 16 corresponds to the main display of the invention. The upper display 33 corresponds to the sub display of the invention. The positions of the main display and the sub display are not particularly limited.

In each of the slot machines 10, the symbols arranged on the liquid crystal display 16 are rearranged and a prize is determined by the symbols rearranged. In addition, when the rearranged symbols satisfy a predetermined second game start condition in any one of the slot machines 10, symbols are rearranged on the upper displays 33 of the slot machines 10.

As shown in FIG. 1, the rearrangement of the symbols on the upper displays 33 is performed on one continuous display band 2. The display band 2 is obtained by virtually connecting the upper displays 33 of the slot machines 10 (10A to 10E). On the respective upper displays 33, displayed are symbols that are located on the upper displays 33 respectively when several symbols are scrolled on the display band 2.

To be more specific, in FIG. 1, the five symbols 3 of "100", "500", "MEGA", "750" and "MINI" are displayed on the display band 2. These symbols 3 are scrolled in a horizontal direction (an arrow direction in FIG. 1). For example, the symbol 3 "MINI" is displayed on the display 10E. Then, it is displayed in an order of the displays 10D, 10C, 10B, 10A and then is again displayed on the display 10E.

The scroll of the symbols on the display band 2 is performed for a predetermined time. Then, the symbols are stopped on the respective upper displays 33. The number of medals to be paid out in each of the slot machines 10 is determined according to the respective symbols 3. The symbols 3 "100", "500" and "750" indicate the number of medals to be paid out.

In addition, "MINI" is a symbol with which the medals corresponding to 10% of a progressive value are paid out. Furthermore, "MEGA" is a symbol with which the medals corresponding to 50% of a progressive value are paid out. The symbols are not limited to the English letters and numerals. For example, a design such as subway may be used.

Figure 2:
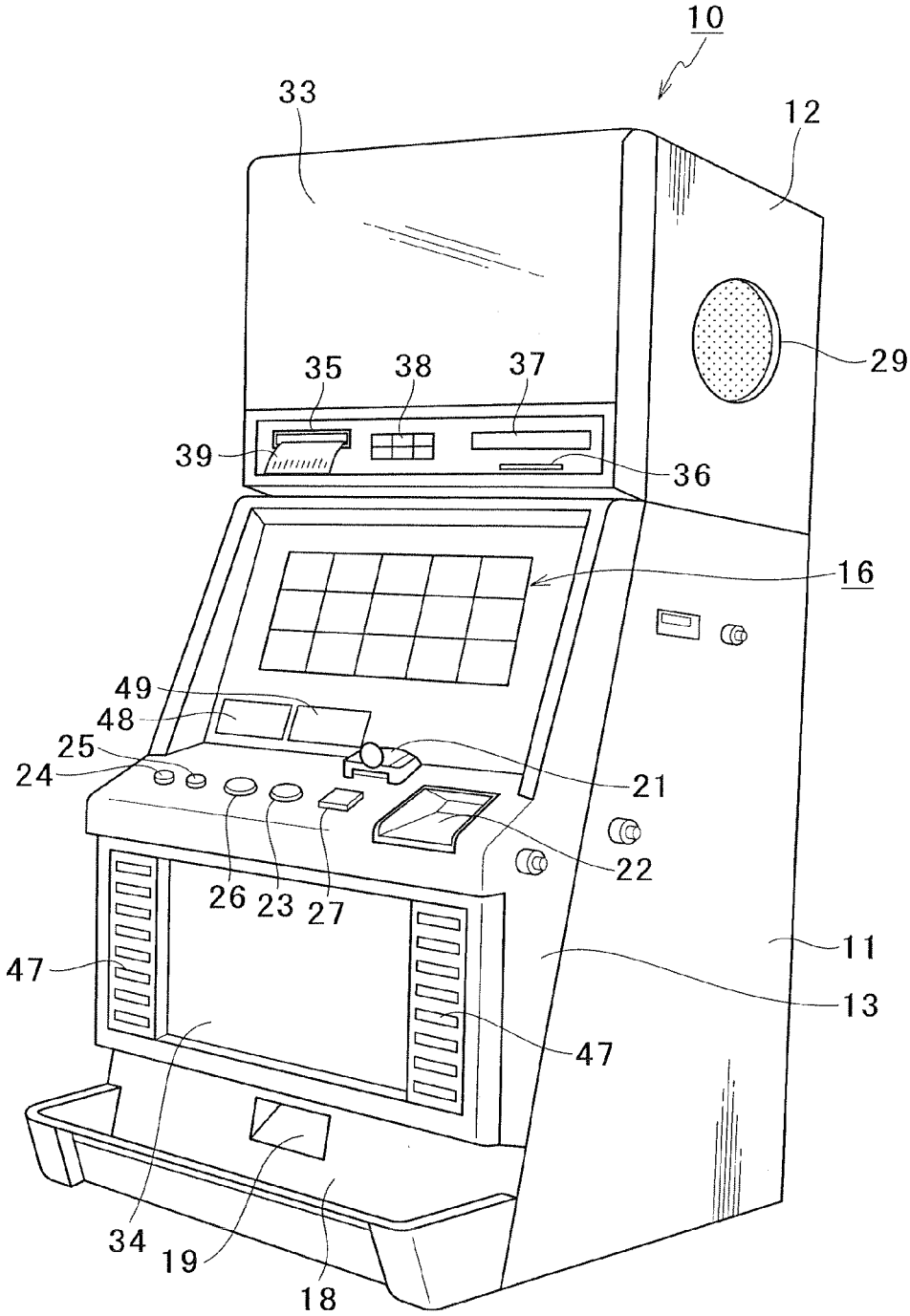
FIG. 2 shows an external appearance of a slot machine constituting the gaming system shown in FIG. 1.

In the followings, the slot machine constituting the gaming system shown in FIG. 1 will be specifically described. FIG. 2 shows an external appearance of the slot machine constituting the gaming system shown in FIG. 1.

As shown in FIG. 2, the slot machine 10 comprises a cabinet 11, a top box 12 provided to an upper part of the cabinet 11 and a main door 13 provided to a front of the cabinet 11. The cabinet 11 is provided with a liquid crystal display 16 at a side facing a player. In addition, the cabinet 11 is provided therein with a variety of constitutional members, such as a controller 40 (refer to FIG. 3) for electrically controlling the slot machine 10, a hopper (refer to FIG. 3) for controlling insertion, storing and payout of a medal, and the like.

In addition, in this embodiment, a medal is exemplified as a game medium that is used to execute a slot game. However, the game medium is not limited to the medal. For example, a medal, a token, electronic bill or electronic value information (credit) equivalent to them may be used.

The main door 13 is openably attached to the cabinet 11. The main door 13 is provided at its center part with the liquid crystal display 16. The liquid crystal display 16 is provided with fifteen sectioned areas of three rows and five columns and the symbols are respectively displayed on each of the sectioned areas. In other words, when a slot game is started, the symbols displayed on each sectioned area are variably displayed at the same time and are stopped at the same time after a predetermined time has elapsed (arranged symbols are rearranged). Based on a combination of the symbols stopped on each sectioned area, a payout is generated. For example, when a winning combination is made by the symbols stopped on the payline, a payout is generated. Meantime, it may be possible that when a predetermined number of scatter symbols are stopped on the sectioned areas, a payout is generated.

In addition, the liquid crystal display 16 is provided at its bottom-left area with a credit display area 49 that displays a current credit and a payout display area 48 that displays a payout.

Below the liquid crystal display 16 provided are a medal insertion slot 21 through which a medal used to play a slot game is inserted and a bill validator 22 that validates whether bill is appropriate or not and receives the genuine bill. In addition, a variety of operation switches are provided around the medal insertion slot 21 and the bill validator 22.

As the operation switches, there are provided a payout switch 23, a MAX BET switch 24, a BET switch 25, a spin repeat BET switch 26 and a start switch 27.

The BET switch 25 is a switch that is used to determine a credit-number to be bet on a slot game to be executed on the liquid crystal display 16. As described below, whenever the BET switch 25, a credit corresponding to one medal is bet.

The spin repeat BET switch 26 is a switch that is used to bet again a credit to execute a slot game, without changing the number of credits bet with the BET switch 25 in a previous game.

The start switch 27 is a switch that is used to start a game after the desired number of credit is bet. After a medal is inserted into the medal insertion slot 21 or a credit is bet by the BET switch 25, the start switch 27 is pushed, whereby a slot game is started on the liquid crystal display 16. The slot game is a game in which symbols are rearranged on the liquid crystal display 16 and a prize is generated which is determined by the symbols rearranged.

The payout switch 23 is a switch that is used to pay out the medals of credits. The medals to be paid out are discharged from a medal payout slot 19 provided at a lower front part of the main door 13, and the medals paid out are accumulated on a medal tray 18. The MAX BET switch 24 is a switch that is used to bet the maximum number (for example, 30 medals) of credits bettable in one slot game with one operation.

A foot display 34 is provided at the lower front part of the main door 13, which displays a variety of images relating to a slot game of the slot machine 10. The images may include, for example a character of the slot machine 10 and the like.

Lamps 47 are provided at both sides of the foot display 34. The lamps 47 emit the lights based on a light-emission pattern that is preset for a slot game to be executed in the slot machine 10. Below the foot display 34, provided is a payout slot 19 through which the medals to be paid out are discharged and a medal tray 18 that accumulates the medals paid out.

A speaker 29 is provided at a side of the top box 12 and an upper display 33 is provided to a front of the top box 12. The upper display 33 has a liquid crystal display and displays a variety of images relating to a slot game, such as character image and the like. In addition, when symbols rearranged on the liquid crystal display 16 satisfy a predetermined second game start condition, symbols are displayed on the upper displays 16 in a form of cooperating with the other slot machines 10, as shown in FIG. 1. As the upper display 33, a display having no frame around a screen is employed so that an image can be displayed without a gap with images (symbols) displayed on the upper displays 33 of the adjacent slot machines 10.

Below the upper display 33, provided are a ticket printer 35, a card reader 36, a data display 37 and a keypad 38.

The ticket printer 35 prints barcode, in which data of identification number of the slot machine 10 and the like are coded, on a ticket and outputs it as a ticket 39 having a barcode attached thereto. A player can cause another slot machine 10 to read out a ticket 39 having a barcode attached thereto so as to play a game in the slot machine, or can exchange the ticket 39 having a barcode attached thereto with bill in a predetermined place of a game arcade (for example, cashier in a casino).

The card reader 36 allows insertion of a smart card and reads out the data from the smart card inserted or writes the data to the smart card. The smart card is a card that is carried by a player and stores the data for identifying a player, the data relating to a history of a game performed by a player, and the like. The smart card may store the data equivalent to coin, bill or credit. In addition, a magnetic stripe card may be adopted instead of the smart card.

The data display 37 is structured from a fluorescent display and the like, and displays the data read out by the card reader 36 or the data inputted through the keypad 38 by a player, for example. The keypad 38 is provided to input an instruction or data relating to a ticket issue and the like.

(Electrical Structure)

Figure 3:
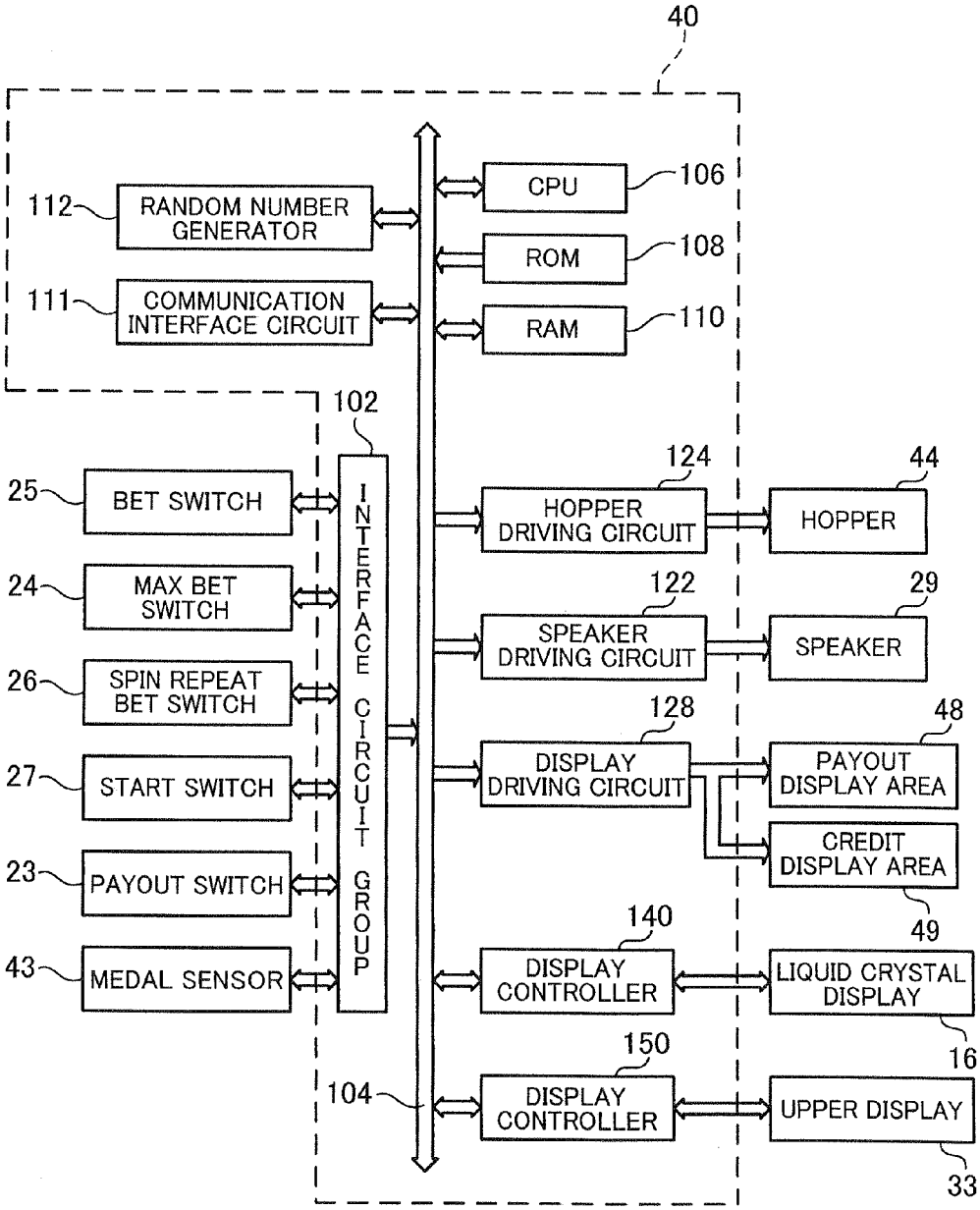
FIG. 3 is a block diagram showing an electrical structure of a controller of the slot machine shown in FIG. 2 and a variety of devices connected to the controller.

FIG. 3 is a block diagram showing an electrical structure of a controller 40 of the slot machine 10 shown in FIG. 2 and a variety of devices connected to the controller 40.

The controller 40 of the slot machine 10 shown in FIG. 3 is a micro computer and includes an interface circuit group 102, an I/O bus 104, a CPU 106, a ROM 108, a RAM 110, a communication interface circuit 111, a random number generator 112, a speaker driving circuit 122, a hopper driving circuit 124, a display driving circuit 128 and display controllers 140, 150.

The communication interface circuit 111 is connected to the other slot machines 10 through a cable (not shown). The slot machines 10 constituting the gaming system 1 can communicate with each other through the communication interface circuit 111.

The interface circuit group 102 is connected to the I/O bus 104. The I/O bus 104 performs an input/output of a data signal or address signal with respect to the CPU 106. The interface circuit group 102 is connected to the start switch 27. A start signal outputted from the start switch 27 is converted into a predetermined signal in the interface circuit group 102 and is then transmitted to the CPU 106 through the I/O bus 104.

Furthermore, to the interface circuit group 102 connected are the BET switch 25, the MAX BET switch 24, the spin repeat BET switch 26 and the payout switch 23. Each switching signal to be outputted from the switches 25, 24, 26, 23 is supplied to the interface circuit group 102, is converted into a predetermined signal in the interface circuit group 102 and is then transmitted to the CPU 106 through the I/O bus 104.

Further, a medal sensor 43 is connected to the interface circuit group 102. The medal sensor 43 is a sensor that detects a medal inserted through the medal insertion slot 21 and is provided near to the medal insertion part of the medal insertion slot 21. A detection signal outputted from the medal sensor 43 is supplied to the interface circuit group 102, is converted into a predetermined signal in the interface circuit group 102 and is then transmitted to the CPU 106 through the I/O bus 104.

(Operations)

Figure 4:
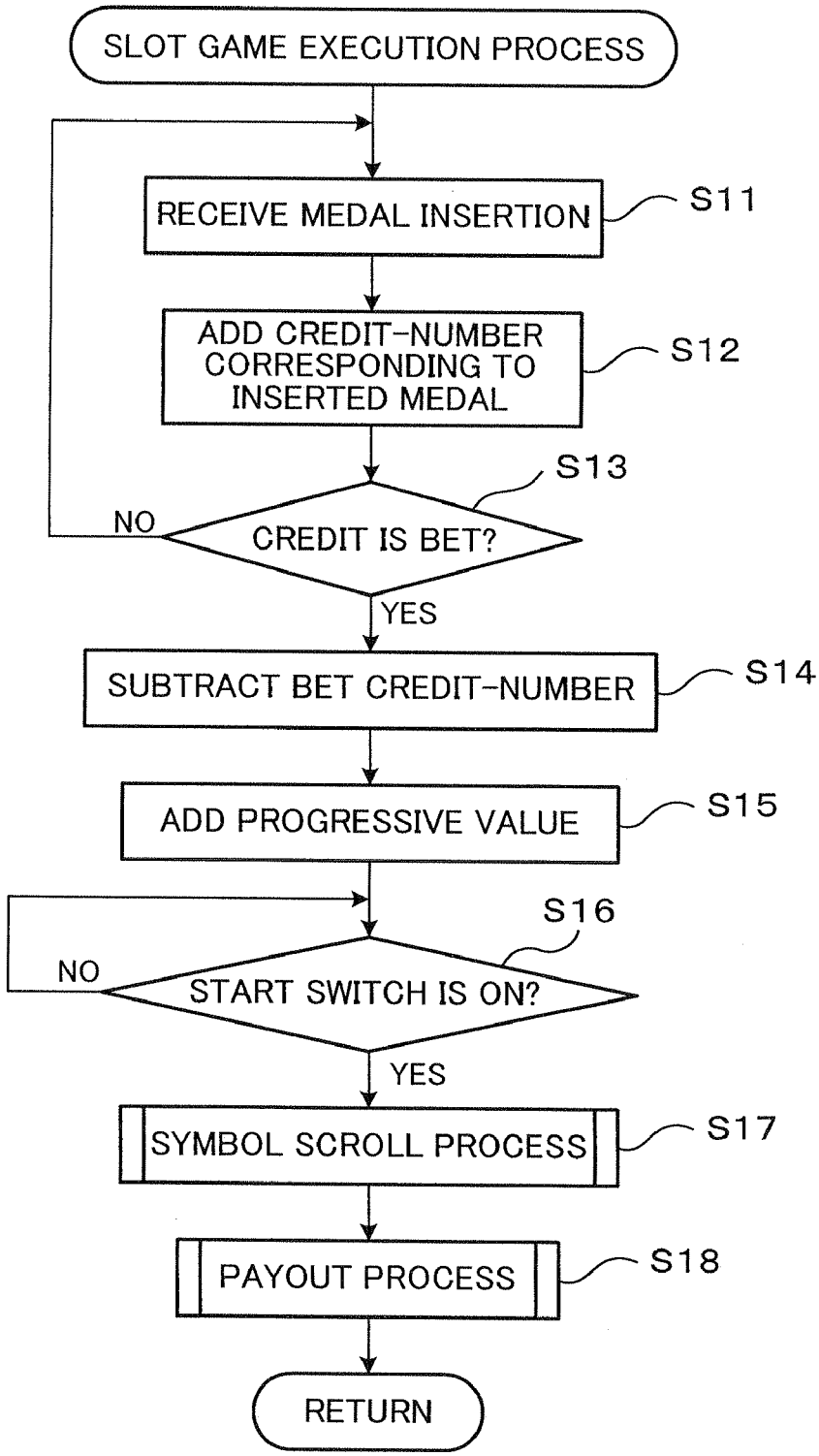
FIG. 4 is a flow chart showing a slot game execution process that is performed in the slot machine shown in FIG. 2.

In the followings, processes of a slot game that is executed in the slot machine 10 will be described with reference to flow charts shown in FIGS. 4 to 6. In the mean time, these processes are processes that the CPU 106 executes a slot game program stored in the ROM 108. FIG. 4 is a flow chart showing a slot game execution process that is performed in the slot machine shown in FIG. 2.

When a slot game execution process shown in FIG. 4 is started, the CPU 106 starts to receive a medal in a step of S11. In this process, a medal inserted from the medal insertion slot 21 by a player is received. When a medal is inserted, the insertion-number thereof is detected by the medal sensor 43.

In a step of S12, the CPU 106 adds the credit-number of the number of the medals inserted, and displays the credit-number after the addition on the credit display area 49. In a step of S13, the CPU 106 determines whether a credit is bet or not. In this process, the CPU 106 determines whether a signal outputted from the BET switch 25 is received when the BET switch 25 is pushed, whether a signal outputted from the MAX BET switch 24 is received when the MAX BET switch 24 is pushed, or whether a signal outputted from the spin repeat BET switch 26 is received when the spin repeat BET switch 26 is pushed. When it is determined that a credit is not bet, the process is returned to the step of S11.

In the mean time, when it is determined in the step of S13 that a credit is bet, the CPU 106 proceeds to a step of S14 and subtracts the credit-number bet. Thereby, the credit after subtraction of the credit-number bet is displayed on the credit display area 49.

Then, the CPU 106 adds a part of the credit-number bet to the progressive value stored in the RAM 110, thereby updating the progressive value (S15). At this time, the CPU 106 transmits through the communication interface circuit 111 a request signal for requesting the other slot machines 10 to add a part of the credit-number bet to the progressive value.

In the mean time, in the slot machine 10 having received the request signal, the CPU 106 thereof updates the progressive value stored in the RAM 110, based on the request signal. Thereby, the slot machines 10 constituting the gaming system 1 can share the progressive value.

In a step of S16, the CPU 106 determines whether the start switch 27 is pushed or not. In this process, the CPU 106 determines whether a signal outputted from the start switch 27 is received when the start switch 27 is pushed. When it is determined that the start switch 27 is pushed, the CPU 106 proceeds to a step of S17 and executes a scroll process of the symbols. In this scroll process, the CPU variably displays the respective symbols displayed on the respective sectioned areas and stops the symbols after a predetermined time has elapsed, thereby displaying new symbols on the respective sectioned areas. When the symbols constituting a winning combination are stopped as a result of the scroll process, a prize is generated. The scroll process will be specifically described later with reference to FIG. 5.

In a step of S18, the CPU 106 executes a payout process. In the payout process, a payout is generated which corresponds to a prize resulting from a winning combination made by the stopped symbols. The payout process will be specifically described with reference to FIG. 6. Like this, the steps of S11 to S18 are repeated, so that a slot game (unit game) is repeatedly executed.

Figure 5:
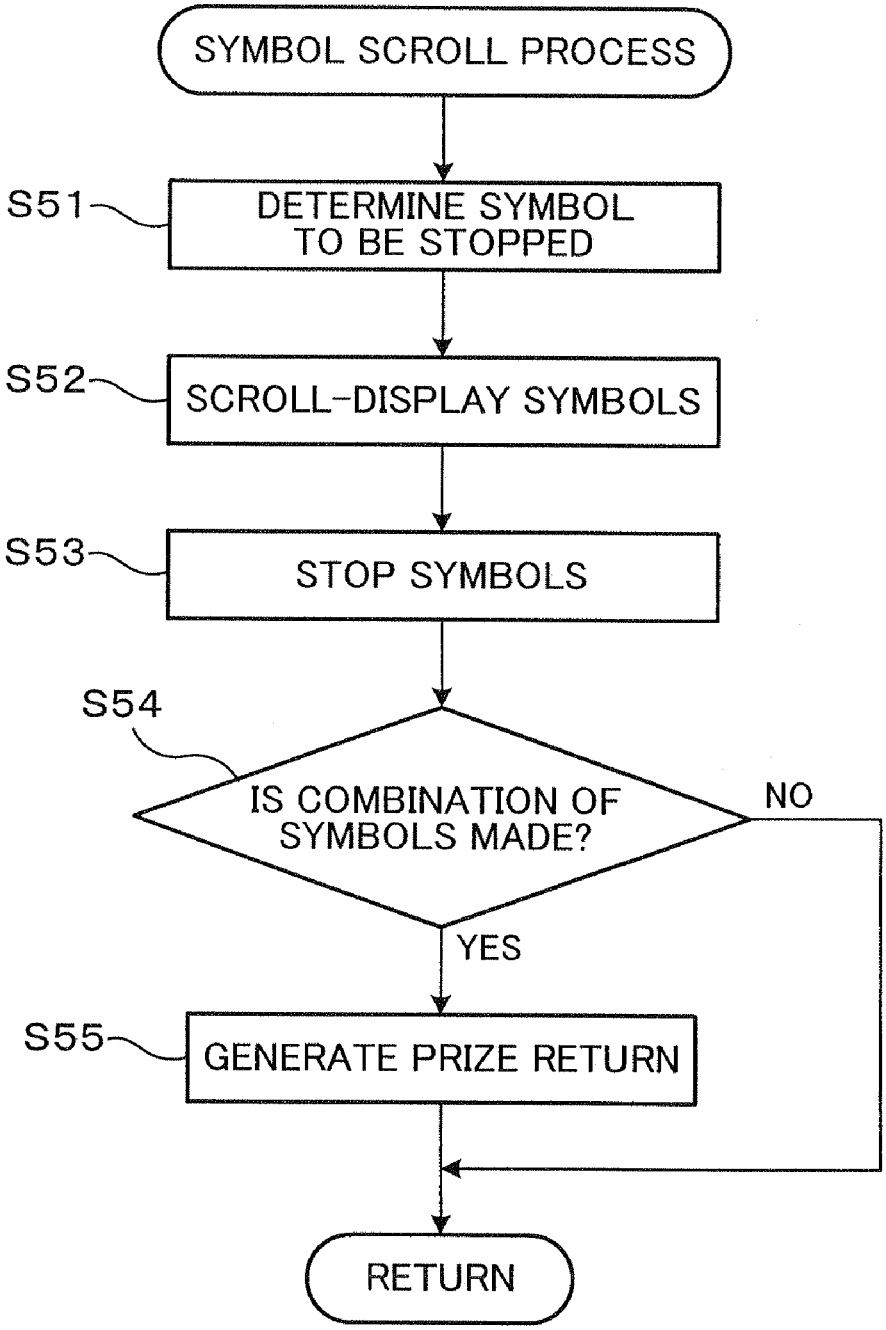
FIG. 5 is a flow chart showing a symbol scroll process that is performed in the slot machine shown in FIG. 2.

FIG. 5 is a flow chart showing a symbol scroll process that is performed in the slot machine shown in FIG. 2.

In a step of S51, the CPU 106 performs a stop symbol determining process. In the stop symbol determining process, the CPU 106 executes a stop symbol determining program that is one of the game execution programs stored in the ROM 108, thereby determining symbols to be stopped on the respective sectioned areas. In this process, the CPU 106 executes a random number generation program to select a random number among the numerical values of "0 to 255" for each of the sectioned areas and refers to a correspondence between the random numbers and the symbols stored in the ROM 108 to determine symbols to be stopped.

Then, in a step of S52, the CPU 106 performs a symbol scroll process. As a result, the symbols are scrolled in the respective sectioned areas. After that, in a step of S53, the CPU 106 performs a symbol stop process. This process is to stop the symbols being scrolled in the respective sectioned areas.

When the symbol stop process is ended, the CPU 106 proceeds to a step of S54 and determines whether a combination of the symbols, i.e., a winning combination is made, based on the symbols stopped in the respective sectioned areas. When it is determined that a winning combination is made, the CPU 106 proceeds to a step of S55. In the step of S55, the CPU 106 generates a prize according to the symbols stopped.

In addition, when the CPU 106 determines in the step of S54 that the symbols are stopped in the respective sectioned areas and a combination of the symbols is not made, it ends the symbol scroll process.

Figure 6:
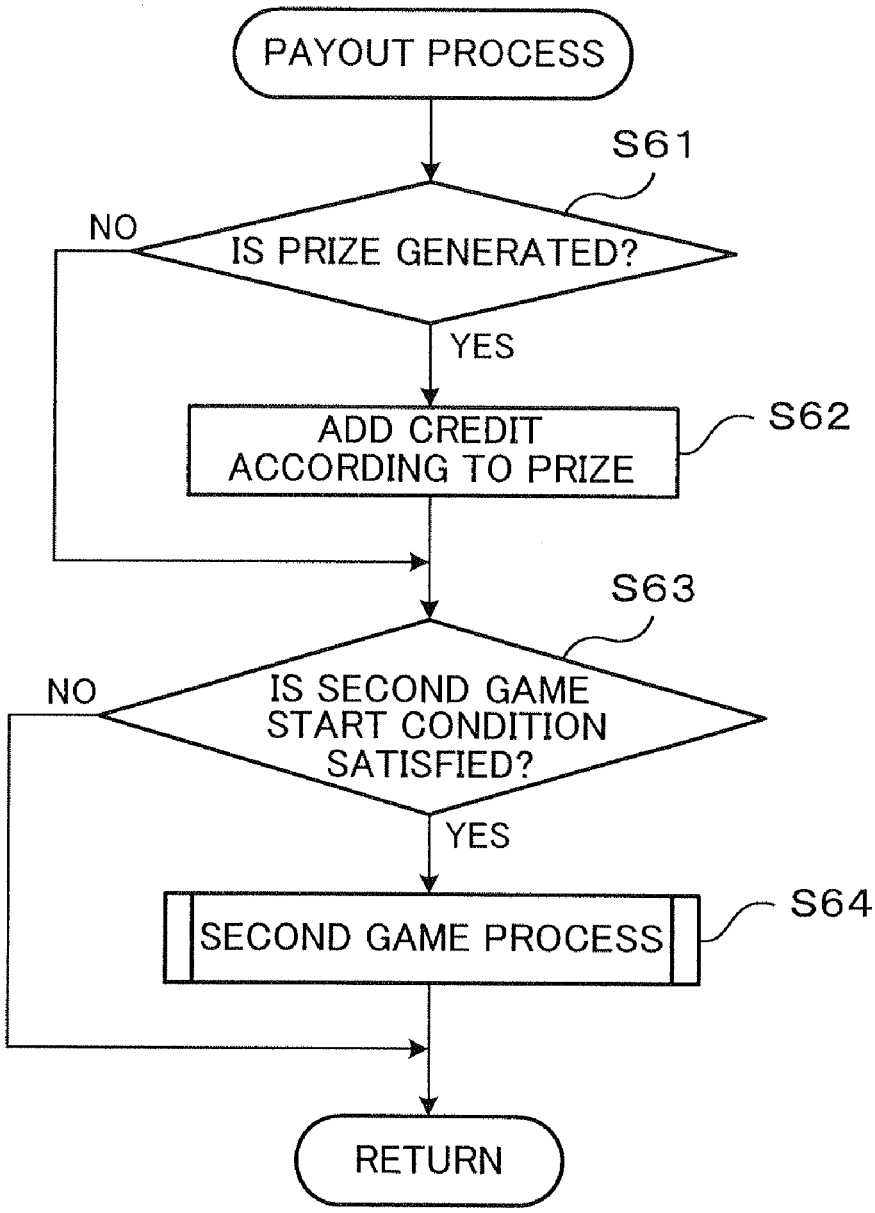
FIG. 6 is a flow chart showing a payout process that is performed in the slot machine shown in FIG. 2.

FIG. 6 is a flow chart showing a payout process that is performed in the slot machine shown in FIG. 2. In a step of S61, the CPU 106 determines whether a prize is generated in the step of S55. When the CPU 106 determines that a prize is not generated in the step of S55, the CPU proceeds to a step of S63.

When the CPU 106 determines that a prize is generated in the step of S55, the CPU adds a credit according to the prize in a step of S62. As a result, the credit-number to be displayed on the credit display area 49 is increased.

Then, the CPU 106 determines whether a second game start condition is satisfied or not (S63). In this embodiment, the second game start condition is that a specific winning combination is made. Accordingly, the CPU 106 determines whether a specific winning combination is made or not.

When it is determined that a specific winning combination is made, the CPU executes a second game process (S64). This process will be described later with reference to FIG. 7. In the step of S63, when it is determined that a second game start condition is not satisfied, or when a second game process is executed, this sub routine is ended. In the mean time, when executing a second game process, the symbol rearrangement on the liquid crystal display 16 may be performed at the same time, or the symbol rearrangement on the liquid crystal display 16 may not be performed.

Figure 7:
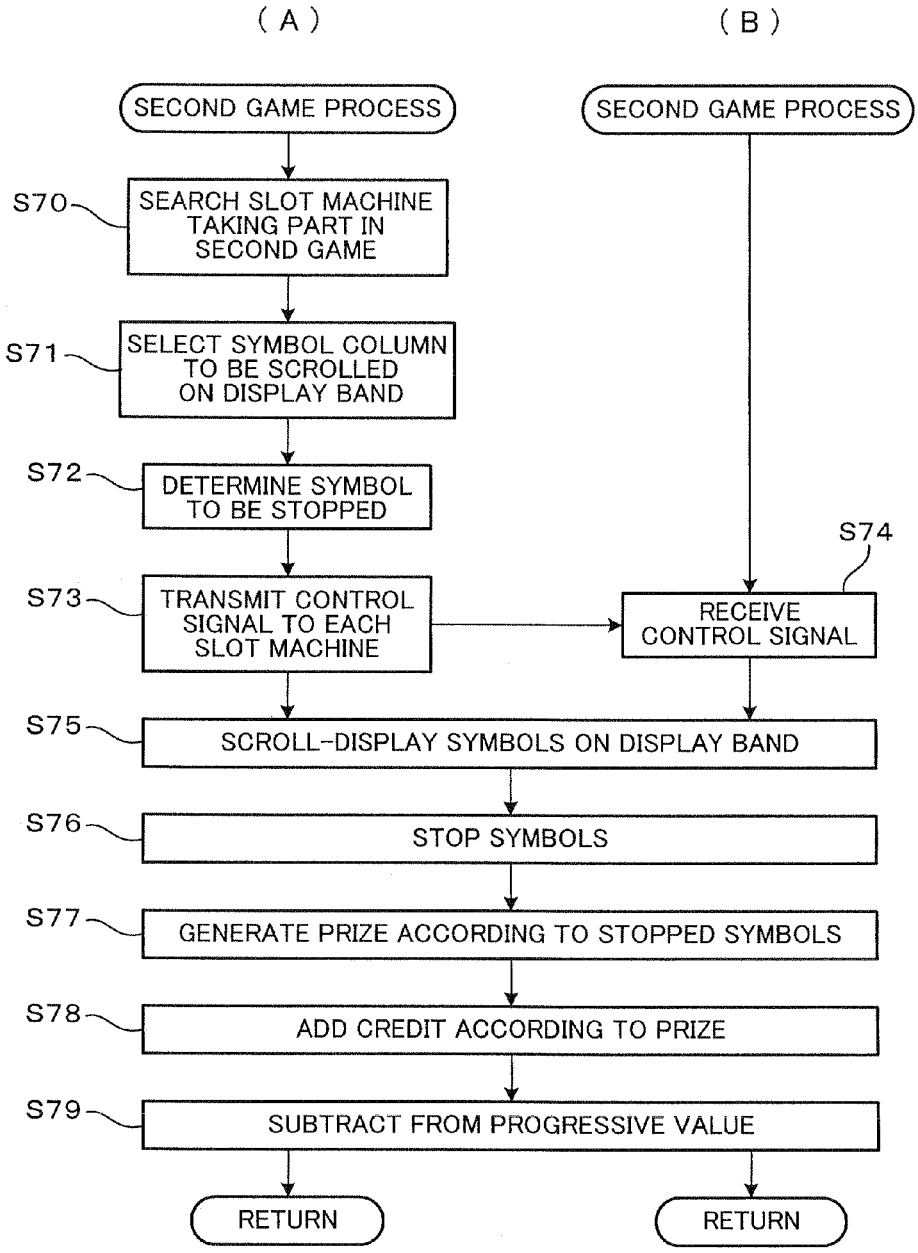
FIG. 7 is a flow chart showing a second game process that is performed in the slot machine shown in FIG. 2.

FIG. 7 is a flow chart showing a second game process that is performed in the slot machine shown in FIG. 2.

FIG. 7(*a*) shows a second game process that is performed in the slot machine that has executed the process shown in FIG. 6. FIG. 7(*b*) shows a second game process that is performed in the slot machines, other than the slot machine performing the process of FIG. 7(*a*).

Firstly, in the process of FIG. 7(*a*), the CPU 106 of the slot machine 10 searches a slot machine 10 that takes part in a second game, among the slot machines 10 constituting the gaming system 1 (S70). The slot machine taking part in a second game, although not particularly limited, may include a slot machine being driven, the predetermined number of adjacent slot machines, all the slot machines capable of performing a communication in a network and the like.

The upper displays 33 of the slot machines 10 searched are virtually connected to constitute one continuous display band 2 (refer to FIG. 1).

As shown in FIG. 1, the slot machines constituting the gaming system are preferably adjacent slot machines. However, the invention is not limited thereto.

Then, in the process of FIG. 7(*a*), the CPU 106 of the slot machine 10 selects a symbol column to be scrolled on the display band 2 (S71). Several types of the symbol columns are stored in the ROM 108. The CPU 106 selects one symbol column among the several types of the symbol columns in the step of S71. In the mean time, in the step of S71, a predetermined number of symbols may be selected among the symbols, thereby constituting a symbol column.

Then, in the process of FIG. 7(*a*), the CPU 106 performs a process of determining symbols to be stopped on the upper displays 33 of the respective slot machines 10 (S72). In the step of S72, the CPU 106 determines a symbol to be stopped on the corresponding upper displays 33 by a lottery using the random numbers, for example. Here, the "lottery" means random selection. Since the symbol column has been selected in the step of S71, when the symbol to be stopped on the upper display 33 of one slot machine 10 is determined, symbols to be stopped on the upper displays 33 of the other slot machines 10 are determined.

In the mean time, it may be possible that the symbols to be stopped on the upper displays 33 of the respective slot machines 10 are first determined and the determined symbols are then arranged to constitute a symbol column to be displayed on the display band 2.

As the steps of S70 to S72 are executed, the slot machines 10 taking part in a second game (slot machines 10 constituting the gaming system 1), the symbol column to be displayed on the display band 2 and the symbols 3 to be stopped on the upper displays 33 of the respective slot machines 10 are determined.

Then, in the process of FIG. 7(*a*), the CPU 106 transmits a control signal to the slot machines 10 taking part in a second game (S73) The control signal includes data for controlling a timing to start a second game, data for specifying a symbol column and data for specifying symbols to be stopped on the upper displays 33. The data for specifying symbols to be stopped on the upper displays 33 includes data that indicates the slot machines 10 in which the corresponding symbols will be stopped.

In the process of FIG. 7(*b*), the CPU 106 receives the control signal (S74). Therefore, in the slot machine 10 executing the process of FIG. 7(*b*), a same symbol column is displayed while scrolling, at a same timing as the slot machine 10 executing the process of FIG. 7(*a*).

In the processes of FIGS. 7(*a*) and 7(*b*), respective CPUs 106 displays, on the upper displays 33, the symbols that are located on the upper displays 33 respectively when the symbols 3 are scrolled on one continuous display band 2 obtained by virtually connecting the upper displays 33 provided to the slot machines 10 (S75). As the step of S75 is executed in the adjacent slot machines 10, the scroll display of the symbols 3 is performed on the one continuous display band 2.

Then, in the processes of FIGS. 7(*a*) and 7(*b*), each of the CPUs 106 stops a symbol on the corresponding upper display 33 (S76), generates a prize relating to the symbol stopped (S77) and adds a credit according to the prize (S78). As a result, the credit-number to be displayed on the credit display area 49 is increased.

Then, in the processes of FIGS. 7(*a*) and 7(*b*), each CPU 106 subtracts a summed value of the credits added in the respective slot machines 10 from the progressive value stored in the RAM 110, thereby updating the progressive value (S79).

According to the gaming system 1, the upper displays 33 of several slot machines 10 are virtually connected to function as one continuous display band 2, and the symbols 3 are scrolled on the display band 2. Therefore, players at the several slot machines 10 can share a sense of playing a game, efficiently.

In the first embodiment, the search of the slot machines 10 taking part in a second game and the determination of the start timing of a second game, the symbol column and the symbols to be stopped are performed in one of the slot machines 10. However, the invention is not limited thereto. For example, several slot machines 10 may be connected to a server. In the followings, such an embodiment will be described.

Figure 8:
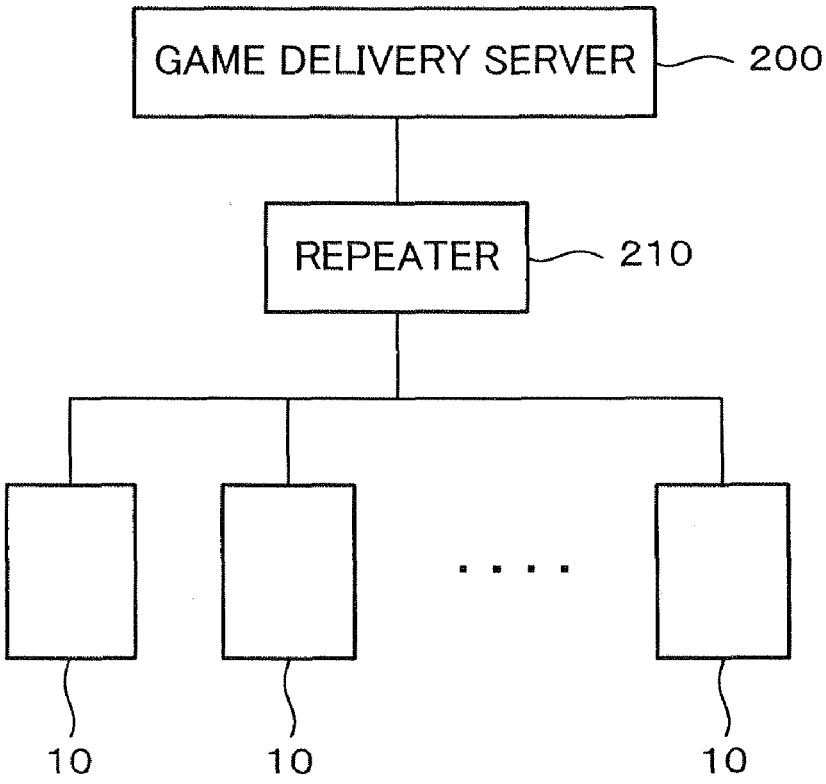
FIG. 8 shows a network connection of a gaming system according to a second embodiment of the invention.

FIG. 8 shows a network connection of a gaming system according to a second embodiment of the invention. As shown in FIG. 8, several slot machines 10 are connected to a game delivery server 200 via a repeater 210. In this case, the game delivery server 200, for example, stores and manage the progressive value (step of S79 in FIG. 7 and the like), and performs various processes (steps of S70 to S73 in FIG. 7 and the like) for determining contents of a second game, and the like.

Each slot machine 10 performs the scroll of the symbols, the stopping of a symbol, the generation of a prize according to the stopped symbol, the addition of the credits (processes of steps of S74 to S78 in FIG. 7 and the like) and the like, based on the control signal (refer to FIG. 7) received from the game delivery server 200.

A controller and various devices connected to the controller provided in each of the slot machines 10 shown in FIG. 8 are same as those shown in FIG. 3. They are connected to the repeater 200 and the game delivery server 200 shown in FIG. 8 through the communication interface circuit 111 shown in FIG. 3.

Figure 9:
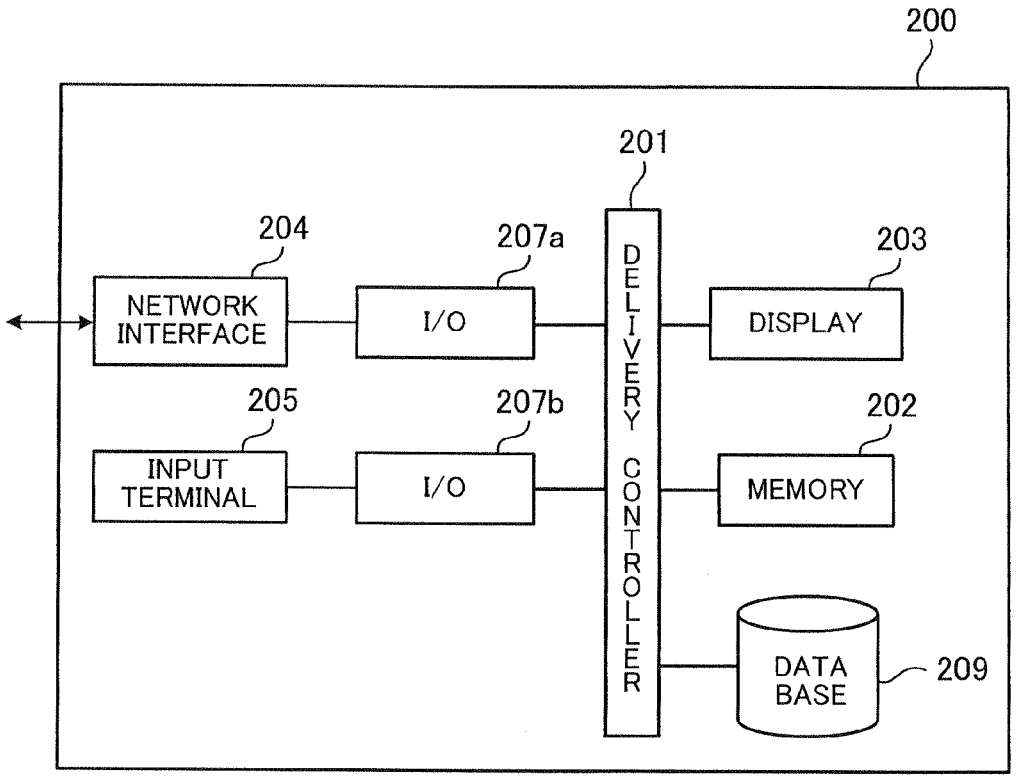
FIG. 9 is a block diagram showing a structure of a game delivery server that delivers a slot game execution program to a slot machine according to a second embodiment of the invention.

FIG. 9 is a block diagram showing a structure of a game delivery server that delivers a slot game execution program to a slot machine according to a second embodiment of the invention. In other words, FIG. 9 is a block diagram showing an electrical structure of the game delivery server 200. As shown in FIG. 9, the game delivery server 200 has a delivery controller 201. The delivery controller 201 is connected to a memory 202, a database 209 and a display 203.

The database 209 stores a program for executing a second game. The program includes image data of a symbol, image data constituting a background of a symbol and the like.

In addition, the delivery controller 201 is connected to I/O ports 207*a*, 207*b*. The I/O port 207*a* is connected to a network interface 204 and the I/O port 207*b* is connected to an input terminal 205. The game delivery server 200 can communicate with each slot machine 10 shown in FIG. 8 through the network interface 204.

A manager of the game delivery server 200 can set a specification of a second game with the input terminal 205, thereby updating the second game.

The specification of the second game, is not particularly limited, but may include a symbol column, a second game start condition and the like. The input terminal 205 may be any of a keyboard, a mouse, a track ball and an operable switch. In addition, the network interface 204 may be a wired network interface or wireless network interface or may include both network interfaces. The game delivery server 200 has a fire wall (not shown) and this interrupts an unauthenticated access to a program in the game delivery server 200.

Figure 10:
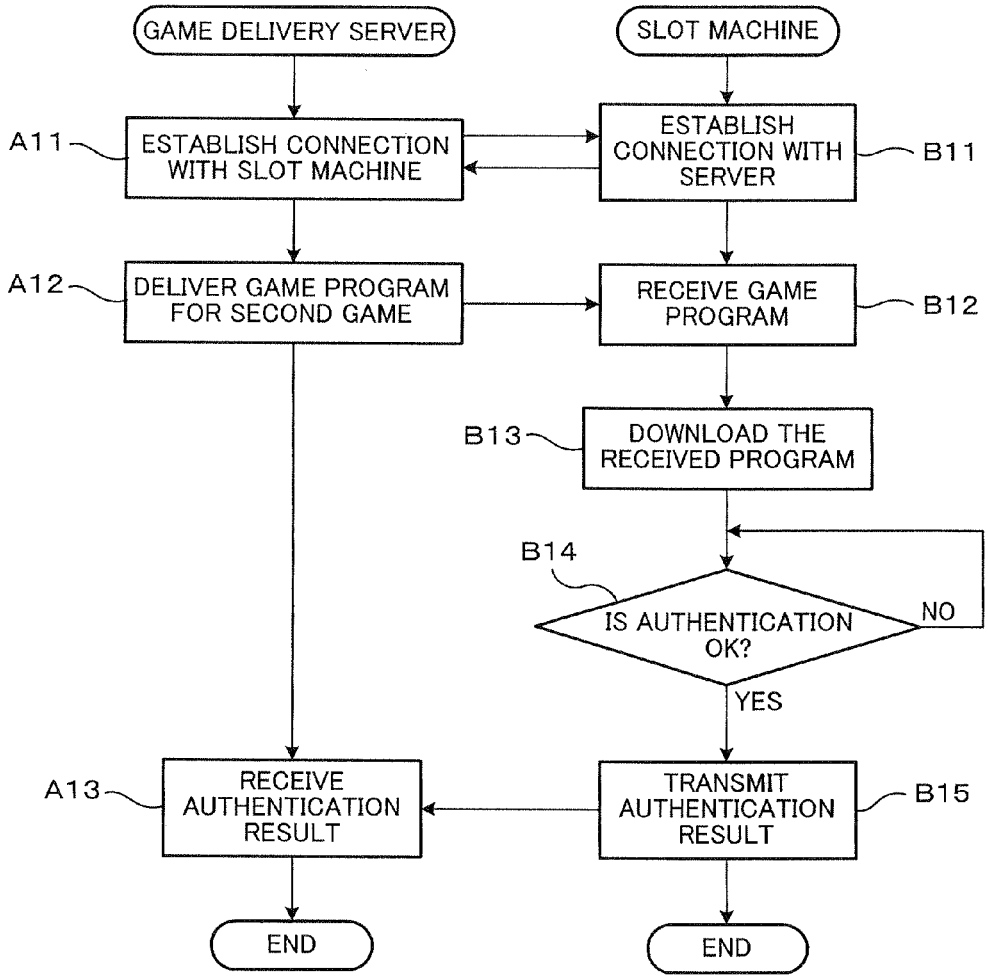
FIG. 10 is a sequence diagram showing an order of data transmission between a slot machine according to a second embodiment of the invention and a game delivery server.

FIG. 10 is a sequence diagram showing an order of data transmission between a slot machine according to a second embodiment of the invention and a game delivery server. In the followings, a process of downloading a second game program delivered from the game delivery server 200 to the slot machine 10 will be described with reference to a sequence diagram shown in FIG. 10.

Firstly, the slot machine 10 outputs a connection request to the game delivery server 200. The game delivery server 200 performs an authentication check based on the connection request and establishes a connection between the slot machine 10 and the game delivery server 200 (A11, B11).

Then, the game delivery server 200 delivers a second game execution program to the slot machine 10 (A12). The slot machine 10 receives the second game execution program delivered from the game delivery server 200 (B12) and downloads the received second game execution program to the ROM 108 (B13)

After that, the slot machine 10 authenticates whether the downloaded second game execution program is falsified or not (B14). When an authentication is confirmed, the slot machine transmits an authentication result to the game delivery server 200 (B15). The game delivery server 200 receives the authentication result transmitted from the slot machine 10 (A16). Like this, by delivering the second game execution program from the game delivery server 200, it is possible to update the contents of the second game in the gaming system 1.

Figure 11:
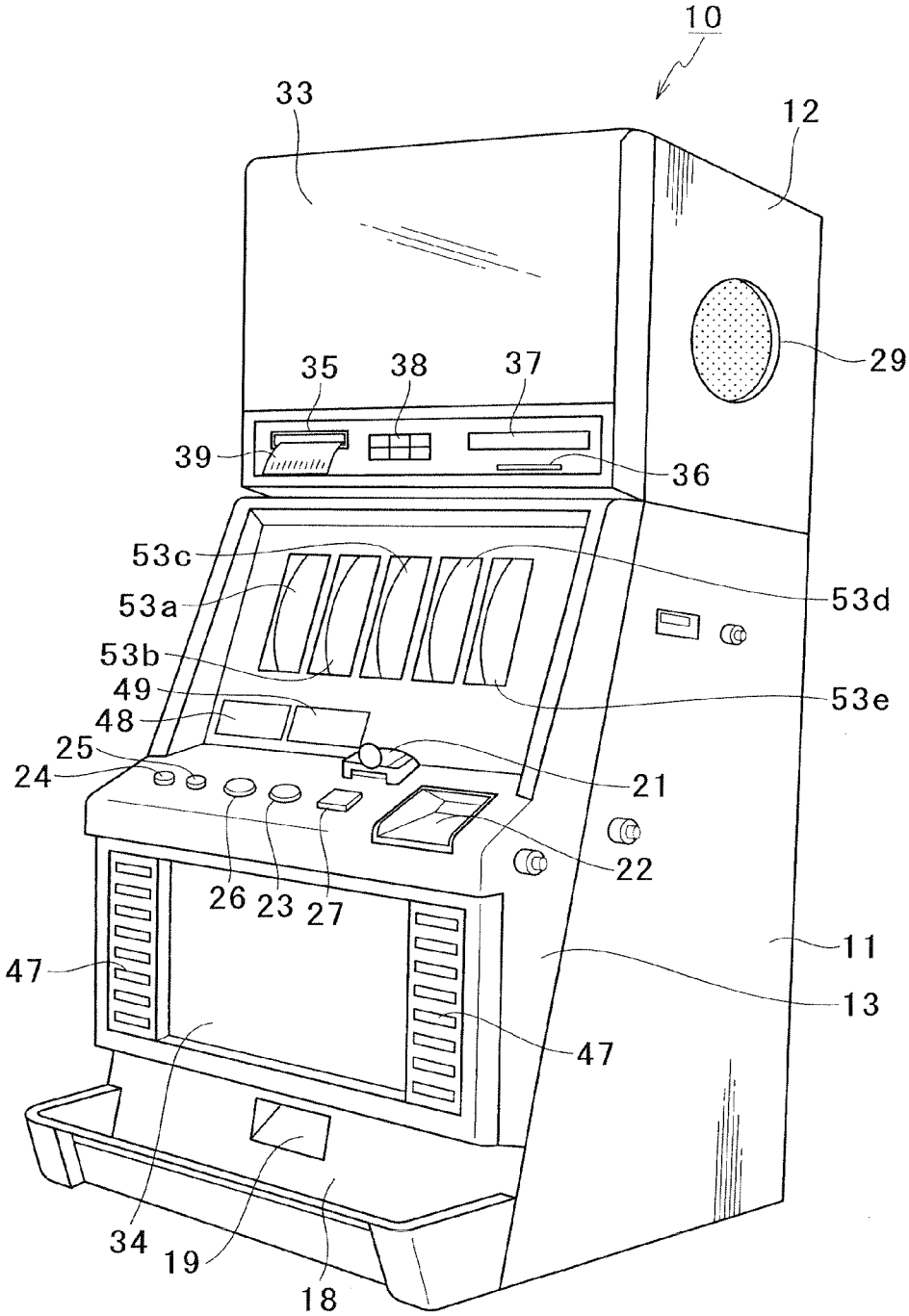
FIG. 11 shows an external appearance of a slot machine constituting a gaming system according to a third embodiment of the invention.

In the first and second embodiments, it has been described that the main display on which a symbol is displayed is the liquid crystal display 16. However, the invention is not limited thereto. FIG. 11 shows an external appearance of a slot machine constituting a gaming system according to a third embodiment of the invention. In FIG. 11, the structural elements same as those shown in FIG. 2 are indicated by the same reference numerals as in FIG. 2.

A slot machine 10 shown in FIG. 11 is different from the slot machine 10 shown in FIG. 2, in that five rotation reels 53*a* to 53*e* are used to execute a slot game. As shown in FIG. 11, five rotation reels 53*a* to 53*e* are provided behind the main door 13 and are visible through display windows 57 provided at a center part of the main door 13. In the present invention, such slot machine 10 can be adopted.

Although the invention has been described with reference to the embodiments, the invention is not limited thereto. For example, a following structure may be adopted. In this embodiment, the gaming system 1 comprises the five slot machines 10. However, in the present invention, the number of the slot machines constituting the gaming system is not particularly limited. In addition, the number of the slot machines constituting the gaming system may not be always constant. For example, like a case where five slot machines selected among ten slot machines at a predetermined timing constitute a gaming system, a gaming system may comprise several slot machines selected among many slot machines.

In addition, in the embodiments, the slot machines 10 are crosswise disposed. However, the invention is not limited thereto. For example, the slot machines may be disposed in a ring or arc shape, seen from a plan view.

In the embodiments, one symbol column is displayed on the display band. However, two or more symbol columns may be displayed. When two or more symbol columns are displayed, the payout-number in each slot machine is determined by the symbols stopped on the sub display. At this time, as the determination method, it may be possible that a payout-number for each symbol is preset and a summed value of the payout-numbers defined for the symbols displayed on the sub display is set as a payout-number. In addition, it may be possible that when a combination of symbols stopped on the sub display is a winning combination, a payout of the number according to the winning combination may be performed.

In the embodiments, when a combination of symbols on the main display is a specific combination, a second game is started. However, the invention is not limited thereto.

The second game start condition may include that a game history in any one slot machine satisfies a predetermined condition, that game histories in the slot machines satisfy a predetermined condition, and the like. The game history may include a payout rate, a difference number, a game-number and the like. The predetermined condition may include that such game history reaches a predetermined value.

Although the slot machine of the invention has been described with reference to the embodiments, the embodiments are provided to illustrate an example of the invention, not to limit the invention. The detailed structures of each means may be appropriately changed. In addition, the effects described in the embodiments of the invention are only to enumerate the most suitable effects to be generated from the invention and the effects of the invention are not limited to those described in the embodiments of the invention.

What is claimed is:

1. A gaming system comprising:

a plurality of slot machines, wherein each of the slot machines includes a main display that displays a plurality of symbols, a sub display that displays a symbol, and a controller that, while rearranging symbols arranged on the main display and generating a prize to be determined by the rearranged symbols, rearranges a symbol arranged on the sub display, and wherein the respective sub displays provided to the plurality of slot machines display symbols that are located on the sub displays respectively when a plurality of symbols are scrolled on one continuous display band obtained by virtually connecting the sub displays, and wherein the controller provided to each of the slot machines rearranges symbols arranged on the main display, and when the rearranged symbols satisfy a predetermined second game start condition, the controller rearranges a symbol on the sub display while rearranging symbols on the main display.

2. The gaming system according to claim 1, wherein the controller provided to each of the slot machines generates a prize that is determined by a symbol arranged on the sub display.

3. A control method of a gaming system having a plurality of slot machines, the method comprising:

rearranging a plurality of symbols arranged on respective main displays in the plurality of slot machines;

generating prizes to be determined by the rearranged symbols;

displaying, on respective sub displays provided to the plurality of slot machines, symbols that are located on the sub displays respectively when a plurality of symbols are scrolled on one continuous display band obtained by virtually connecting the sub displays; and rearranging a symbol on the sub display of each of the plurality of slot machines while symbols on the main display are rearranged when the rearranged symbols satisfy a predetermined second game start condition.

4. The control method of a gaming machine according to claim 3, further comprising:

generating a prize that is determined by a symbol arranged on the sub display of each of plurality of the slot machines.

* * * * *